US005532710A

United States Patent [19]

Rodeffer

[11] Patent Number: 5,532,710

[45] Date of Patent: Jul. 2, 1996

[54] SATELLITE DISH STACKING SYSTEM

[75] Inventor: Mark A. Rodeffer, Burlington, Iowa

[73] Assignee: Winegard Company, Burlington, Iowa

[21] Appl. No.: 262,941

[22] Filed: Jun. 21, 1994

[51] Int. Cl.[6] ..... H01Q 15/14

[52] U.S. Cl. ..... 434/912; 343/914

[58] Field of Search ..... 343/912, 914, 343/915, 916, 837, 840; 414/788.2, 795.6, 798.4; H01Q 15/14

[56] References Cited

U.S. PATENT DOCUMENTS

| | | | |
|---|---|---|---|
| 2,679,003 | 5/1954 | Dyke et al. | 343/912 |
| 3,599,219 | 8/1971 | Holtum et al. | 343/912 |
| 4,731,617 | 3/1988 | Gray et al. | 343/912 |
| 4,909,412 | 3/1990 | Cerf | 414/795.6 |
| 4,916,459 | 4/1990 | Kurosawa et al. | 343/840 |

FOREIGN PATENT DOCUMENTS

| | | | |
|---|---|---|---|
| 0064766 | 5/1977 | Japan | 414/788.2 |
| 0997100 | 6/1965 | United Kingdom | 414/788.2 |
| 1052990 | 12/1966 | United Kingdom | 414/788.2 |

*Primary Examiner*—Donald T. Hajec
*Assistant Examiner*—Tan Ho
*Attorney, Agent, or Firm*—Dorr, Carson, Sloan & Birney

[57] ABSTRACT

A system is described for vertically stacking a plurality of satellite dishes for bulk transport and storage using minimal space. Each satellite dish has a parabolic dish with a stacking rim attached to its outer periphery at an angle of about 125 degrees. The stacking rim has two circumferential support regions on opposite surfaces. When the satellite dishes are stacked vertically, the support regions of the stacking rims abut, leaving a space between the parabolic surfaces of adjacent dishes. This space has the same dimensions as the thickness of the material forming the dishes. The support provided by the abutting support regions also causes the edges of the rims of stacked dishes to be separated by a space so that the dishes can be easily separated when needed.

23 Claims, 4 Drawing Sheets

Fig. 1
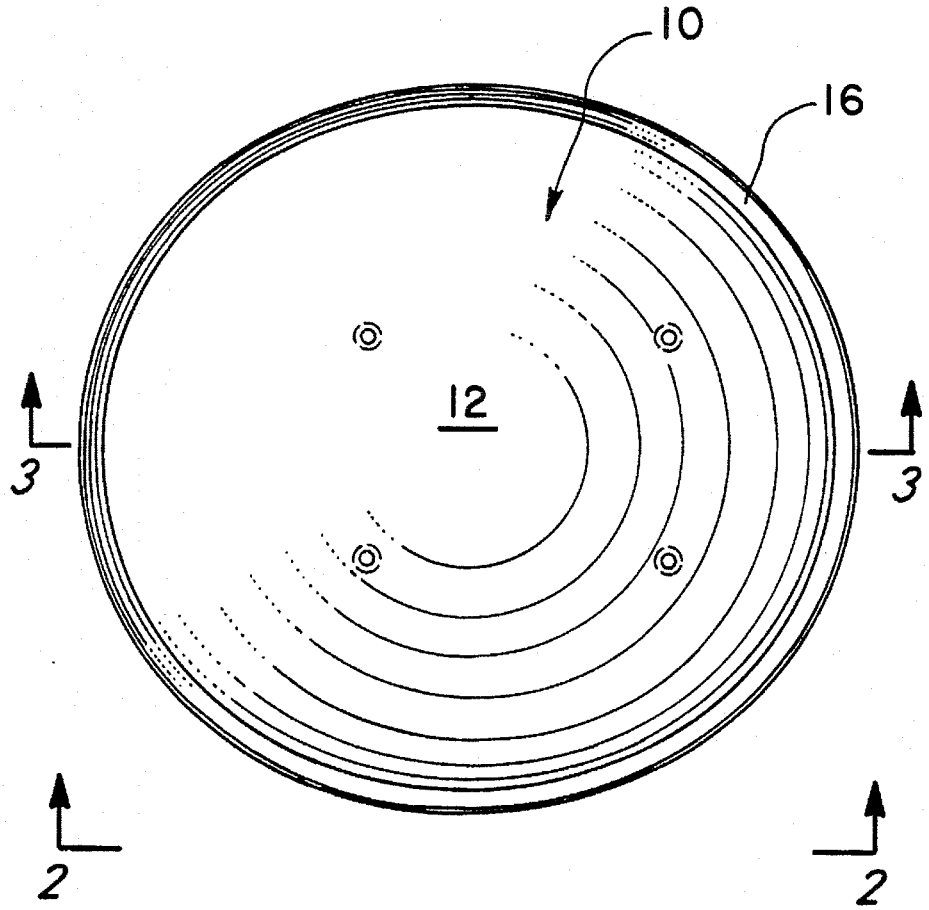
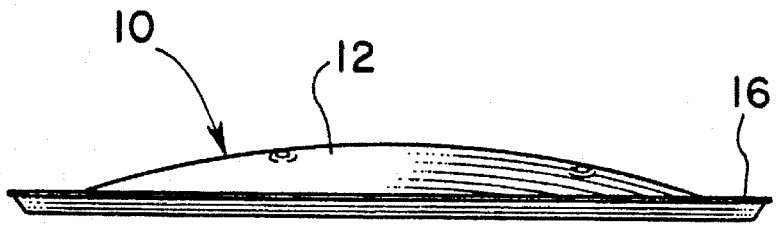
Fig. 2

SATELLITE DISH STACKING SYSTEM

BACKGROUND OF THE INVENTION

1. Field of the Invention

The present invention relates to a system for stacking satellite dishes for shipping and, more particularly, to a system for stacking parabolic satellite dishes in such a way as to provide high stacking density while minimizing parabolic dish deformation.

2. Statement of the Problem

Television transmission via satellite has long been a method of choice for transmitting high-quality television signals to areas where cable television cannot be used and conventional over-the-air broadcasts cannot be received or are of poor quality. Historically, television signals are transmitted from a satellite in geosynchronous orbit to a rather large (i.e., 8 to 10 feet in diameter) satellite dish antenna aimed at that particular satellite. Such satellite dish antennas are expensive and demand a large investment from the user in terms of cost and space.

A new satellite television transmission system has been devised using small (i.e., 18-inch diameter) satellite dish antennas that can reach both users who live in urban areas and users who live in rural areas or who otherwise cannot be served by the above-described conventional systems. Each antenna is formed of solid or perforated material in a parabolic shape and has conventional mounts to support an offset feed. Such small diameter antennas can only be used when they are manufactured within a small tolerance of variation through the entire parabolic surface such as 20 mils r.m.s. (root mean square). Deformation beyond such small tolerances can significantly affect the quality of the programming received.

It is foreseeable that the users of this new television transmission system will number in the millions. As a result, large numbers of small diameter satellite dish antennas will have to be shipped to various locations. It would be most cost-effective to ship these multitudes of antennas in bulk as vertical stacks of nested dishes mounted on shipping pallets. However, when parabolic dishes are vertically nested and stacked, the weight of the dishes can permanently deform the lowermost parabolic dishes beyond the tolerances acceptable for their accurate performance as signal-receiving devices. Such stacked parabolic dishes also tend to adhere together, especially under such stacking pressure, and become difficult to separate.

Therefore, a need exists for a system for stacking large numbers of parabolic dishes for shipping and storage in a minimum space (i.e., high-density stacking) while maintaining the integrity of the shape of each parabolic dish. The system should preferably also enable the stacked parabolic dishes to be easily separated from one another.

3. Solution to the Problem

The system of the present invention enables large numbers of parabolic dishes of satellite dish antennas to be nested and stacked in a high density, lowering shipping costs of bulk amounts of dishes, while at the same time providing meaningful support for the parabolic dishes and further providing a space between adjacent parabolic dishes so that the overall quality of the parabolic dishes is maintained. The space provided between adjacent dishes is small, maximizing the number of dishes that can be nested in a single stack. The space exists along the majority of the surface area of each stacked parabolic dish. The remainder of the surface of the parabolic dish through a uniquely designed stacking rim forms a "nesting region" with adjacent dishes in which the outer circumference of the dish is subject to non-permanent deformation.

In addition, the system of the present invention provides a space between the edges of adjacent parabolic dishes when they are stacked. This edge space enables the dishes to be separated when needed with a minimum effort. The system also minimizes "locking" of the rims of adjacent stacked dishes.

The stacking support rim of the satellite dishes minimizes interference with the operation of the antenna while presenting an aesthetic appearance. Finally, the rim provides support for the dish during use, especially during wind load and severe environmental conditions such as icing and snow load.

SUMMARY OF THE INVENTION

The present invention comprises a system for high density stacking of a plurality of satellite parabolic dishes with a curved reflector surface and a corresponding curved surface opposing the reflector surface on the opposite side of the dish. A formed stacking rim surrounds the circumference of each satellite dish and is attached to the curved opposing surface at a predetermined angle. The formed stacking rim has a first concentric support region adjacent to the opposing surface of the satellite dish and a second concentric support region adjacent to the reflector surface of the satellite dish and directly opposite the first support region.

When the parabolic dishes are stacked, the following stacking relationship is achieved. The second support region of a first satellite dish abuts the first support region of an adjacent satellite dish when the reflector surface of the first satellite dish is nested on top of the opposing surface of the adjacent satellite dish. The abutment of the first and second support regions in the stacking rim separates substantially the entire reflector surface of the first satellite dish from the entire opposing surface of the adjacent satellite dish by a space substantially equal to the thickness of the material forming each satellite dish (i.e., the distance between the curved reflector surface and the opposing surface). The abutment of the first and second support regions also causes the outer edges of the adjacent formed stacking rims to be separated so that the dishes can be easily removed from the stack.

BRIEF DESCRIPTION OF THE DRAWING

FIG. 1 is a bottom elevational view of the satellite dish of the present invention.

FIG. 2 is a side elevational view of the satellite dish of the present invention.

DETAILED DESCRIPTION

Figures 3A, 3B, 3C:
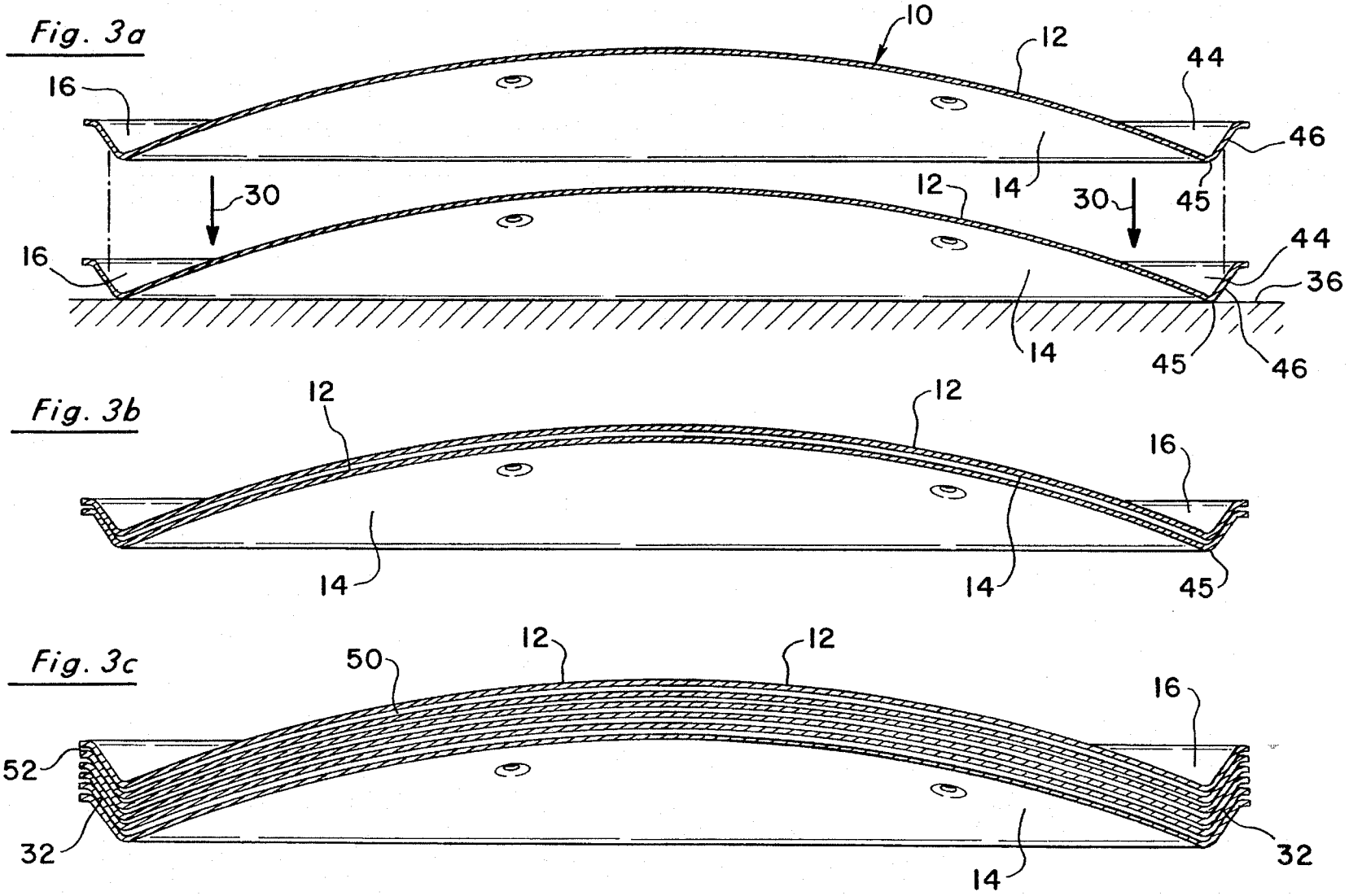
FIG. 3*a* is a cross-sectional view showing the stacking of two satellite dishes of the present invention.
FIG. 3*b* is a cross-sectional view showing two stacked satellite dishes of the present invention.
FIG. 3*c* is a cross-sectional view illustrating a plurality of stacked satellite dishes of the present invention.

1. Structure of the Parabolic Dish. FIGS. 1 and 2 show a satellite dish of the system of the present invention. (The same numbers are used to refer to the same elements in various figures.) A parabolic dish 10 is surrounded at its outer periphery by an integral stacking rim 16 of the present invention. The parabolic dish 10 has a curved parabolic reflector surface 14, best seen in FIG. 3, that conventionally reflects signals from a satellite into an offset feed horn, not shown. A curved parabolic surface 12 opposes the reflector surface 14. For convenience throughout, the term "reflecting surface" refers to surface 14 and the term "opposing surface" refers to surface 12. The material between the surfaces is preferably steel-based and is formed in manufacturing in the desired parabolic shape for the frequencies being received. In the preferred embodiment, the dish has the shape of an ellipse, forming a circular aperture when pointed at a satellite. In the ellipse of the preferred embodiment, the major diameter including the stacking rim 16 is 20.85 inches and the minor diameter including the stacking rim 16 is 19.17 inches. The thickness 54 (shown in FIG. 5) of the material is 33 mils, and the dish is formed in a preferable tolerance of 20 mils r.m.s. It is to be understood that the teachings of the present invention could be used for a parabolic dish antenna of any desired size, thickness, or tolerance.

Figure 4:
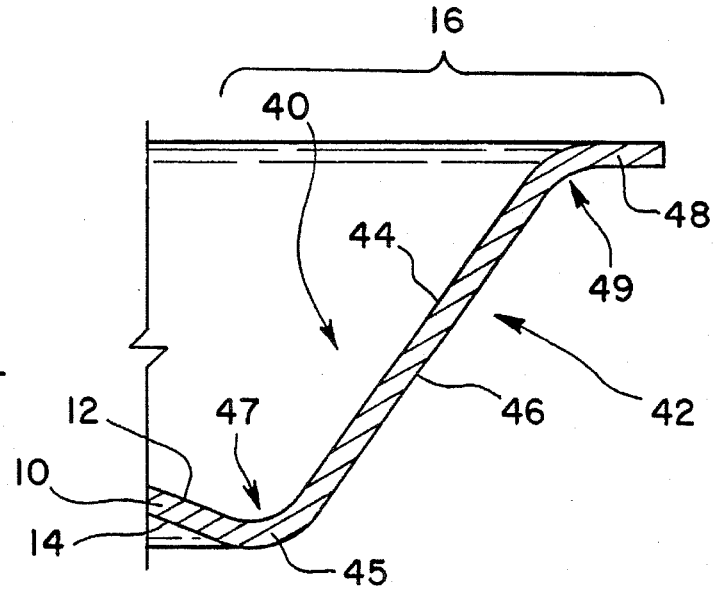
FIG. 4 is an enlarged partial cross-sectional view of the nesting region of the present invention.

FIG. 4 shows the details of the stacking rim 16 of the present invention and its relationship to the parabolic dish 10. The stacking rim 16 has a first linear side 40 on which is found a first supporting region 44 that is adjacent to the opposing surface 12 of the parabolic dish 10. A second linear side 42 of the stacking rim 16 exists directly opposite the first linear side 40 and adjacent to the reflecting surface 14 of the parabolic dish 10. The second linear side 42 has a second supporting region 46. Both the first and second supporting regions 44 and 46 are concentric to the parabolic dish 10.

In the preferred embodiment shown in FIG. 4, the stacking rim 16 is an integral part of the dish. The material from which the dish is formed is also bent 47 near the outer periphery of the parabolic dish 10 so that the first side 40 of the stacking rim 16 forms an obtuse angle 70 (shown in FIG. 7(*b*)) measured from the horizontal surface on which the dish 10 rests. As discussed in more detail below, the use of a predetermined angle 70 prevents permanent deformation of the parabolic dishes 10 when the dishes 10 are stacked, for example, for shipping or storage. It is understood that the stacking rim 16 can also be attached to the parabolic dish 10 in any manner that would give the desired ability of preventing permanent deformation of the stacked dishes 10.

The stacking rims 16 of the present invention have an edge 48. The edge 48 of the stacking rim 16 is formed by recurving the outer periphery of the stacking rim 16 in a second bend 49 in the direction opposite that of the first bend 47 that formed angle 70. The angle $\theta_2$, or 76 (shown in FIG. 7(*b*)), that results between the stacking rim 16 and the edge 48 is substantially equal to angle 70, so that the edge 48 is substantially parallel to the surface upon which the dish 10 rests when it is oriented for stacking.

In the preferred embodiment, the first and second supporting regions 44 and 46 of the stacking rim 16 are about 0.5 inch long, and the edge 48 is about 0.1 inch long. The radius of the first bend 47 between the opposing surface 12 and the stacking rim 16 and the radius of the second bend 49 between the stacking rim 16 and the edge 48 are both about 0.125 inch. It is to be understood that other dimensions for the stacking rim 16, edge 48, and radii of bends 47 and 49 can be used that provide support for and separability of the stacked dishes 10 as taught by the present invention.

The first bend 47 forms a countersink 45 upon which the lowermost dish 10 in a stack rests when it is placed in the stacking position described herein below.

Figure 3D:
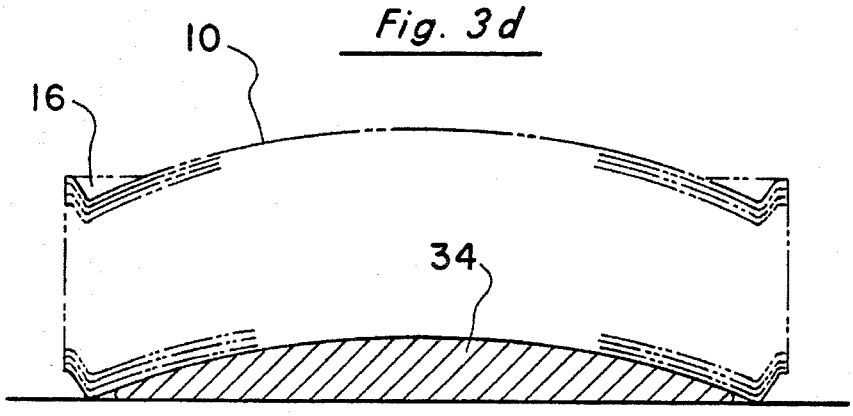
FIG. 3*d* is a cross-sectional view showing an optional support with a plurality of stacked satellite dishes of the present invention.

2. Stacking System. FIGS. 3(*a–c*) illustrate how the satellite dishes 10 of the present invention are vertically stacked. In FIG. 3(*a*) a dish 10 is placed with its reflecting surface 14 facing downward toward a surface 36 and its opposing surface 12 facing upward. The first support region 44 of the rim 16 likewise faces upward, while the second support region 46 faces in a downward direction. The first dish is supported on the surface 36 by the countersink 45 formed by the bend 47 between the parabolic dish 10 and the stacking rim 16.

A second dish 10 is then stacked on the first dish 10 as shown by the arrows 30 in FIG. 3(*a*) and by FIG. 3(*b*). The stacking rim 16 and the countersink 45 aid in the correct orientation of the second dish 10 atop the first dish 10. Once the dishes 10 are correctly oriented, the second support region 46 of the second dish 10 rests upon the first support region 44 of the first dish 10, while the reflecting surface 14 of the second dish 10 nests over the opposing surface 12 of the first dish 10. Additional dishes are similarly placed on the stack until a desired number of dishes is stacked, as shown in FIG. 3(*c*). Because the stacking rim 16 is designed so that a space 50 is maintained between adjacent parabolic dishes 10 and a space 52 is provided between the edges 48 of adjacent stacking rims 16 when the dishes are nested, as described in greater detail below and illustrated in FIG. 5, while the support regions 44 and 46 touch, a region 32 can be seen where the support regions 44 and 46 abut throughout the stack.

An optional support 34 shown in FIG. 3(*d*) can be placed beneath the lowermost parabolic dish 10 to provide additional support to the center of the dish 10. It is to be expressly understood that the optional support 34 is not necessary to achieve the stated objectives of the present invention.

Figure 5:
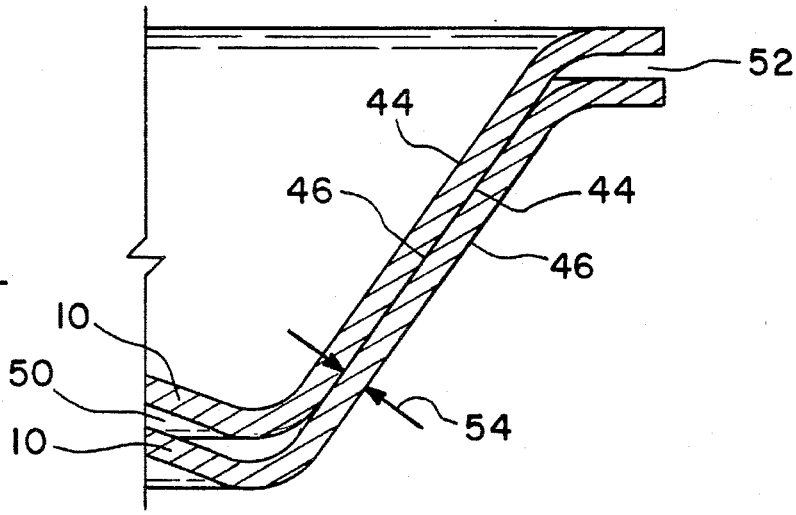
FIG. 5 shows an enlarged partial cross-sectional view of the nesting region of two stacked satellite dishes of the present invention.

FIG. 5 provides a detailed view of a pair of nested dishes 10. When the upper dish 10 is nested on the adjacent lower dish 10, a substantial portion of the second support surface 46 of the stacking rim 16 of the upper dish abuts a substantial portion of the first support surface 44 of the stacking rim 16 of the adjacent lower dish 10. This abutment suspends the upper dish 10 above the adjacent lower dish 10 such that a space 50 exists between the upper and lower parabolic dishes 10. This space 50 occurs over substantially the entire area of the parabolic dishes 10.

In addition to producing a space 50 between adjacent stacked parabolic dishes 10, the abutment of the first and second support regions 44 and 46 also creates a space 52 between the edges; 48 of the adjacent dishes 10. The space 52 that is created by the abutment of the first and second support regions 44 and 46 enables the adjacent stacked dishes 10 to be separated easily when necessary.

In the preferred embodiment shown in FIG. 5, the space 50 between adjacent parabolic dishes 10 is substantially equivalent to the thickness 54 (i.e., 33 mils) of the material that forms each parabolic dish 10. The space 52 between adjacent edges 48 is also substantially equivalent to the thickness 54. It is important to note that the system of the present invention permits the use of spaces 50 and 52 having dimensions other than those described above for the preferred embodiment.

3. Design Considerations.

(a) Rim. It is a primary object of the system of the present invention to avoid permanent deformation of the parabolic dishes 10 when they are stacked for shipping or storage. When parabolic dishes 10 without rims are stacked, eventually the weight of the stack will tend to flatten or stretch the bottommost dishes 10 beyond the point where the dishes 10 can recover their original form (permanent deformation). The perimeters of the bottommost dishes 10 without rims 16 will vary more than an acceptable range for accurate performance in receiving signals from satellites.

Figure 6A:
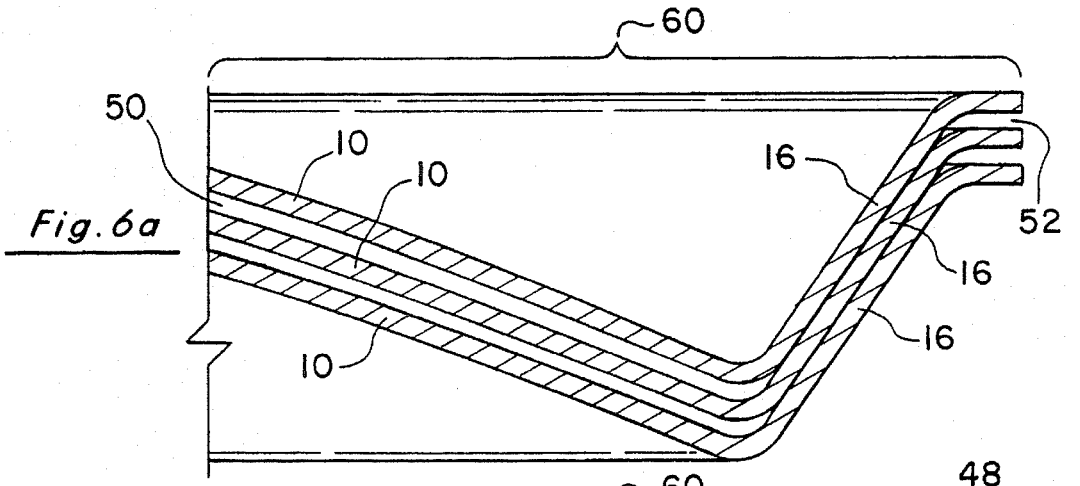
FIGS. 6(*a–b*) illustrate an enlarged partial cross-sectional view of the nesting region of the dishes at the (a) top and (b) bottom of a stack of satellite dishes of the present invention.
Figure 6B:
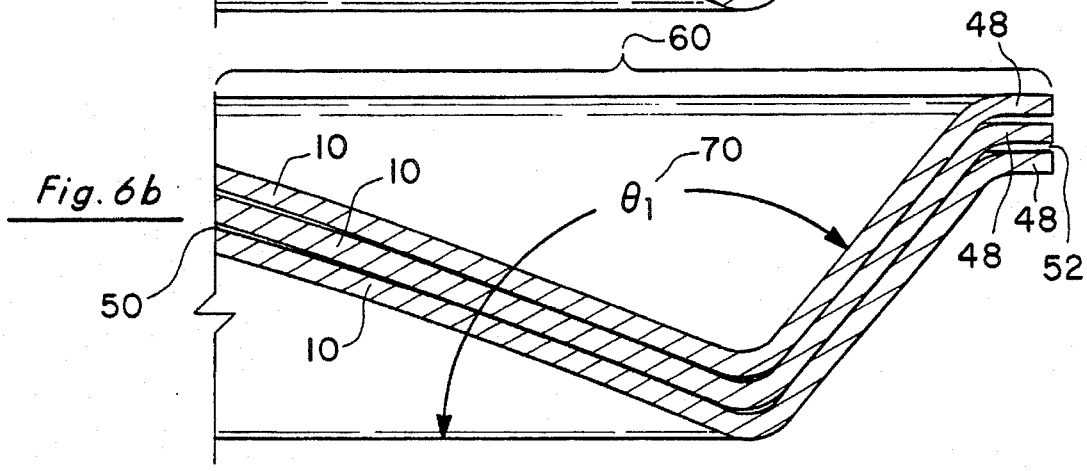

The addition of a stacking rim 16 of the present invention shifts the vertical forces from the entire parabolic dish 10 to a region including the rim 16 and the outer periphery of the parabolic dish 10 ("nesting region" 60). The effects of the stacking rim 16 of the present invention on the deformation of the parabolic dishes 10 are illustrated in FIG. 6(*a–b*), which show the nesting regions 60 of various sizes of stacks of dishes 10. FIG. 6(*a*) shows the relationship between the stacking rims 16 and parabolic dishes 10 of three stacked dishes 10. Although a slight deformation occurs in the lowermost dish 10 in its nesting region 60, this deformation is non-permanent and the lowermost parabolic dish 10 will regain its proper shape when the dish 10 is no longer stacked ("elastic deformation").

The range of elastic deformation of the parabolic dish 10 with the stacking rim 16 of the present invention is such that a large number of dishes 10 can be stacked before the forces acting on the dish 10 cause permanent deformation of the lowermost dishes 10. For example, up to 150 dishes 10 of the preferred embodiment have been stacked without exceeding the elastic recovery abilities of the dishes 10 and permanently affecting the quality of the parabolic surfaces. FIG. 6(*b*) illustrates the bottommost three dishes 10 in a stack of 150. The weight of the stack of 150 dishes 10 (approximately 450 pounds) causes the lowermost parabolic dishes 10 to somewhat stretch and flatten horizontally, increases the angle 70, and largely negates the spaces 50 between adjacent parabolic dishes 10 in the nesting region 60 and spaces 52 between adjacent edges 48. However, when the dishes 10 are unstacked, because the elastic deformation range has not been exceeded, the dishes 10 are able to regain their original parameters as shown in FIGS. 4 and 6(*a*).

(b) Angle 70. Another factor affecting the ability of the dishes 10 to resist permanent deformation when stacked is the angle $\theta_1$, or 70, between the stacking rim 16 and the parabolic dish 10. As described above, when the stacking rim 16 is missing altogether, the perimeters of the lowermost parabolic dishes 10 of a stack may lose definition depending on the design of the dish 10 and the height and weight of the stack. The addition of a stacking rim 16 prevents this loss of quality in the perimeter of the parabolic dish 10 when stacked. However, the angle 70 at which the stacking rim 16 joins the perimeter of the parabolic dish 10 affects the nesting characteristics of the dishes, as described below.

Figure 7A:
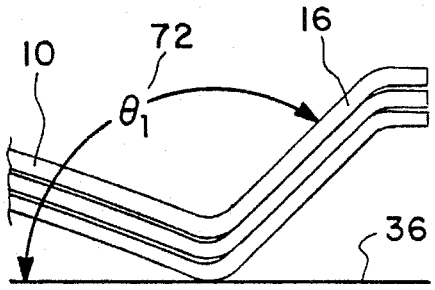
FIGS. 7(*a–c*) show an enlarged partial cross-sectional view of the nesting region of the satellite dishes of the present invention with the rim at an angle of (a) greater than 125 degrees, (b) 125 degrees, and (c) less than 125 degrees.
Figure 7B:
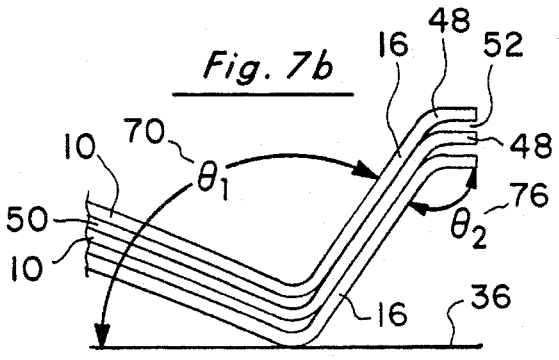
Figure 7C:
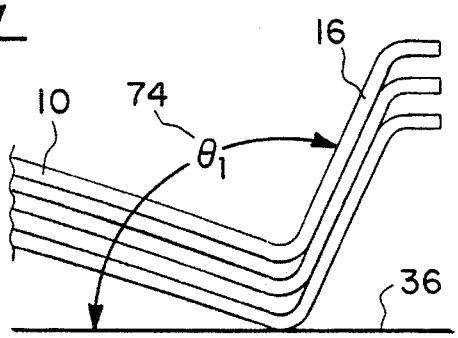

Ideal nesting characteristics, as described for the preferred embodiment above, are provided by a stacking rim 16 having an angle 70 of about 125 degrees with respect to the horizontal surface on which the dish 10 rests, as illustrated by FIG. 7(*b*). At this angle 70 the optimum spaces 50 and 52 are obtained between adjacent parabolic dishes 10 and between adjacent edges 48 of stacking rims 16. These optimum spaces 50 and 52 in the preferred embodiment are equal and equal to the thickness 54 of the dish 10. This angle 70 also optimizes the elastic deformation properties of the nesting region 60 of stacked dishes as described above. Although 125 degrees is optimum for angle 70, a reasonable variance in the degrees will not negatively affect the nesting characteristics provided by the angle 70.

However, a larger variance in the angle 70 will detrimentally affect the desired nesting characteristics of the dishes. For example, if angle 70 increases toward 180 degrees, as shown by angle 72 in FIG. 7(*a*), the parameters of the stacked parabolic dishes 10 will vary by more than an acceptable range, similar to the permanent deformation described above that occurs in stacked dishes 10 without a stacking rim 16. An increased angle 72 will also cause sidelobe interference and be less aesthetically pleasing.

If, on the other hand, the angle 70 decreases from 125 degrees toward 90 degrees, as illustrated by angle 74 in FIG. 7(*c*), significant nesting problems result. With the stacking rim 16 at angle 74, the horizontal forces resulting from the weight of upper dishes 10 act more strongly on the stacking rims 16 of lower dishes 10 than they do at the optimum angle 70 of 125 degrees. This causes the stacking rims 16 to lock together, making it difficult to separate the dishes 10 after stacking. As angle 74 approaches 90 degrees, the stacking rims 16 begin to interfere with each other such that the first and second supporting regions 44 and 46 can no longer abut.

The above disclosure sets forth a number of embodiments of the present invention. Other arrangements or embodiments, not precisely set forth, could be practiced under the teachings of the present invention and as set forth in the following claims.

I claim:

1. A system for stacking a plurality of satellite dishes, each of said satellite dishes having a reflector surface and a surface opposing said reflector surface, said system comprising in combination:

a first supporting region formed on said opposing surface of each of said plurality of satellite dishes;

a second supporting region formed on said reflector surface of each of said plurality of satellite dishes opposite said first supporting region;

said first supporting region of a given satellite dish abutting against said second supporting region of an adjacent satellite dish when said reflector surface of said adjacent satellite dish nests in said opposing surface of said given satellite dish, the abutment of said first and second supporting regions separating said reflector surface of said adjacent satellite dish a predetermined space apart from said opposing surface of said given satellite dish.

2. The system of claim 1, wherein said predetermined space has a size substantially equal to the distance between said reflector surface and said opposing surface of each of said plurality of satellite dishes.

3. The system of claim 1, wherein said first and second supporting regions are located near the outer peripheries of said opposing and reflector surfaces, respectively.

4. The system of claim 1, wherein the outer periphery of each of said plurality of satellite dishes is elliptical.

5. A system for stacking a plurality of satellite dishes, each of said satellite dishes having a curved reflector surface and a curved surface opposing said curved reflector surface, each of said satellite dishes having a elliptical periphery, said system comprising in combination:

a first concentric supporting region formed on said curved opposing surface near said circular periphery of each of said plurality of satellite dishes;

a second concentric supporting region formed on said curved reflector surface near said circular periphery of each of said plurality of satellite dishes opposite said first concentric supporting region;

said first concentric supporting region of a given satellite dish abutting said second concentric supporting region of an adjacent satellite dish when said curved reflector surface of said adjacent satellite dish nests in said curved opposing surface of said given satellite dish, the abutment of said first and second concentric supporting regions separating the entirety of said curved reflector surface of said adjacent satellite dish a predetermined space apart from the entirety of said curved opposing surface of said given satellite dish.

6. The system of claim 5, wherein said predetermined space has a size substantially equal to the distance between said curved reflector surface and said curved opposing surface of each of said plurality of satellite dishes.

7. A system for stacking a plurality of satellite dishes, each of said satellite dishes having a reflector surface and a surface opposing said reflector surface, said system comprising in combination:

a formed integral rim surrounding the outer periphery of each of said plurality of satellite dishes, said formed integral rim having a first side and a second side, said second side opposing said first side;

a first supporting region on said first side of said formed integral rim adjacent to said opposing surface of each of said plurality of satellite dishes;

a second supporting region on said second side of said formed integral rim adjacent to said reflector surface of each of said plurality of satellite dishes; and said first supporting region of a given satellite dish abutting against said second supporting region of an adjacent satellite dish when said reflector surface of said adjacent satellite dish nests in said opposing surface of said given satellite dish, the abutment of said first and second supporting regions separating said reflector surface of said adjacent satellite dish from said opposing surface of said given satellite dish by a space substantially equal to the distance between said reflector surface and said opposing surface of each of said plurality of satellite dishes.

8. The system of claim 7, further comprising a second space at the distal edge of said formed rim between said first side of said formed rim of said given satellite dish and said second side of said formed rim of said adjacent satellite dish.

9. The system of claim 7, wherein said second space has a size substantially equal to the size of said first space between said reflector surface of said given satellite dish and said opposing side of said adjacent satellite dish.

10. The system of claim 7, wherein each of said plurality of satellite dishes has an outer periphery.

11. The system of claim 10, wherein said formed rim of each of said plurality of satellite dishes is attached at a predetermined angle to said outer periphery of each of said plurality of satellite dishes.

12. The system of claim 7, wherein the outer periphery of each of said plurality of satellite dishes is elliptical.

13. A system for stacking a plurality of satellite dishes, each of said satellite dishes having a curved reflector surface and a curved surface opposing said curved reflector surface, each of said satellite dishes having an outer periphery, said system comprising in combination:

a formed integral rim attached at a predetermined angle to said outer periphery of each of said plurality of satellite dishes, said formed integral rim having a first side adjacent to said curved opposing surface and having a second side adjacent to said curved reflector surface, said formed integral rim having an edge;

a first supporting region on said first side of said formed integral rim concentric to said outer periphery;

a second supporting region on said second side of said formed integral rim concentric to said outer periphery; and a substantial portion of said first concentric supporting region of a given satellite dish abutting against a substantial portion of said second concentric supporting region of an adjacent satellite dish when said curved reflector surface of said adjacent satellite dish nests in said curved opposing surface of said given satellite dish, the abutment of said first and second supporting regions separating the entirety of said curved reflector surface of said adjacent satellite dish apart from the entirety of said curved opposing surface of said given satellite dish by a space substantially equal to the thickness of one of said plurality of satellite dishes and further separating the edge of said formed integral rim of said adjacent satellite dish apart from the edge of said formed integral rim of said given satellite dish by a space substantially equal to the thickness of one of said plurality of satellite dishes.

14. The system of claim 13, wherein said predetermined attachment angle minimizes sidelobe interference between said formed integral rim and said curved reflector surface.

15. The system of claim 13, wherein said predetermined attachment angle is about 125 degrees.

16. The system of claim 13, wherein said outer periphery of each of said plurality of satellite dishes is elliptical.

17. A satellite dish, said satellite dish comprising:

a curved parabolic reflector surface;

a curved parabolic surface opposing said curved parabolic reflector surface; and a stacking rim formed on the outer periphery of said parabolic dish at a predetermined angle, said stacking rim further comprising:

a first linear side having a first support region;

a second linear side directly opposite said first side, said second side having a second support region, so that said second support region abuts said first support region when one said satellite dish is stacked adjacent to a second said satellite dish; and an edge attached to the outer periphery of said stacking rim at a second predetermined angle.

18. The satellite dish of claim 17, wherein said first predetermined angle is in the range of 100 degrees to 180 degrees.

19. The satellite dish of claim 18, wherein said first predetermined angle is about 125 degrees.

20. The satellite dish of claim 17, wherein said second predetermined angle is equal to but opposite from said first predetermined angle.

21. The satellite dish of claim 20, wherein said second predetermined angle is about 125 degrees.

22. The satellite dish of claim 17, wherein said outer periphery of said satellite dish is elliptical.

23. A satellite dish, said satellite dish comprising:

a curved parabolic reflector surface;

a curved parabolic surface opposing said curved parabolic reflector surface; and an integral stacking rim formed on the outer periphery of said satellite dish at a predetermined angle between said integral stacking rim and a plane surface delineated by said outer periphery of said satellite dish, said predetermined angle being about 125 degrees, said integral stacking rim further comprising:

an outer periphery;

an edge attached to said outer periphery of said integral stacking rim at a second predetermined angle, said edge being substantially parallel to said plane, said second predetermined angle measured between said edge and said integral stacking rim, said second predetermined angle being equal to but opposite from said first predetermined angle, said second predetermined angle being about 125 degrees;

a first linear side adjacent to said curved opposing parabolic surface, said first linear side having a first support region between said first angle and said second angle; and a second linear side opposite said first side and adjacent to said curved parabolic reflector surface, said second linear side having a second support region between said first angle and said second angle.

* * * * *